US008549698B1

(12) United States Patent
Lai

(10) Patent No.: US 8,549,698 B1
(45) Date of Patent: Oct. 8, 2013

(54) VACUUM CLEANER WITH WIND-DRIVEN LIGHTING EQUIPMENT

(75) Inventor: Vincent Lai, Taoyuan Hsien (TW)

(73) Assignee: In Win Development, Inc., Taoyuan Hsien (TW)

( * ) Notice: Subject to any disclaimer, the term of this patent is extended or adjusted under 35 U.S.C. 154(b) by 254 days.

(21) Appl. No.: 13/244,360

(22) Filed: Sep. 24, 2011

(51) Int. Cl.
*A47L 5/00* (2006.01)

(52) U.S. Cl.
USPC ..... 15/324; 15/330

(58) Field of Classification Search
USPC ..... 15/320, 324, 330
IPC ..... A47L 5/00
See application file for complete search history.

(56) References Cited

U.S. PATENT DOCUMENTS

| | | | | |
|---|---|---|---|---|
| 2,637,062 | A * | 5/1953 | Sutton et al. | 15/324 |
| 6,023,814 | A * | 2/2000 | Imamura | 15/339 |
| 7,328,479 | B2 * | 2/2008 | Willenbring | 15/324 |
| 7,562,414 | B2 * | 7/2009 | Oh et al. | 15/339 |
| 8,172,932 | B2 * | 5/2012 | Oh et al. | 96/382 |

* cited by examiner

*Primary Examiner* — David Redding
(74) *Attorney, Agent, or Firm* — Pro-Techtor Int'l Services

(57) ABSTRACT

A vacuum cleaner with wind-driven lighting is characterized in that an interior of an ordinary vacuum cleaner is installed with a wind-driven power generation device constituted by fan blades, an acceleration gear set and a generator. When the vacuum cleaner is operating, a suction force of the vacuum cleaner is converted into wind-driven power to provide electricity needed by an LED. Therefore, at a same time when the vacuum cleaner is operating, by this energy-saving device for the generation of wind-driven power, light can be illuminated on blind spots inside a house where a light intensity is insufficient.

3 Claims, 4 Drawing Sheets

VACUUM CLEANER WITH WIND-DRIVEN LIGHTING EQUIPMENT

BACKGROUND OF THE INVENTION a) Field of the Invention

The present invention relates to a vacuum cleaner, and more particularly to a vacuum cleaner which is provided with a function of LED (Light Emitting Diode) illumination driven by wind power when the vacuum cleaner is operating.

b) Description of the Prior Art

An interior of an ordinary vacuum cleaner is provided with a motor and a fan to suck in dust and garbage on a floor using vacuum suction, thereby achieving an effect of cleaning. However, none of the ordinary vacuum cleaner is equipped with lighting equipment; therefore, when the vacuum cleaner is used to clean blind spots inside a house, it is usually not easy to clean as there is no sufficient light intensity. Although there are vendors who have developed a car-use vacuum cleaner on which a lighting device is installed, as electricity of that lighting device is from rechargeable batteries, a car-use or a house-use power source must be spent, which is not environmental friendly and thus requires to be improved.

SUMMARY OF THE INVENTION

Accordingly, the primary object of the present invention is to provide a vacuum cleaner with wind-driven lighting equipment, wherein the suction force of the vacuum cleaner is converted into wind power to provide electricity required by an LED, thereby saving energy while providing the vacuum cleaner with a function of illumination.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
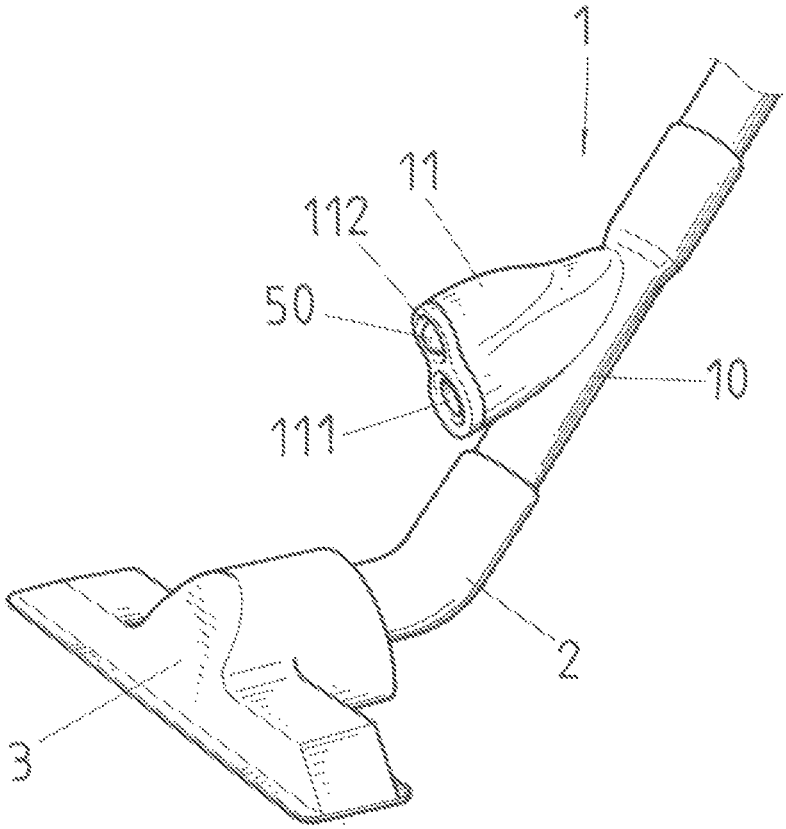
FIG. 1 shows a perspective view of the present invention.
Figure 2:
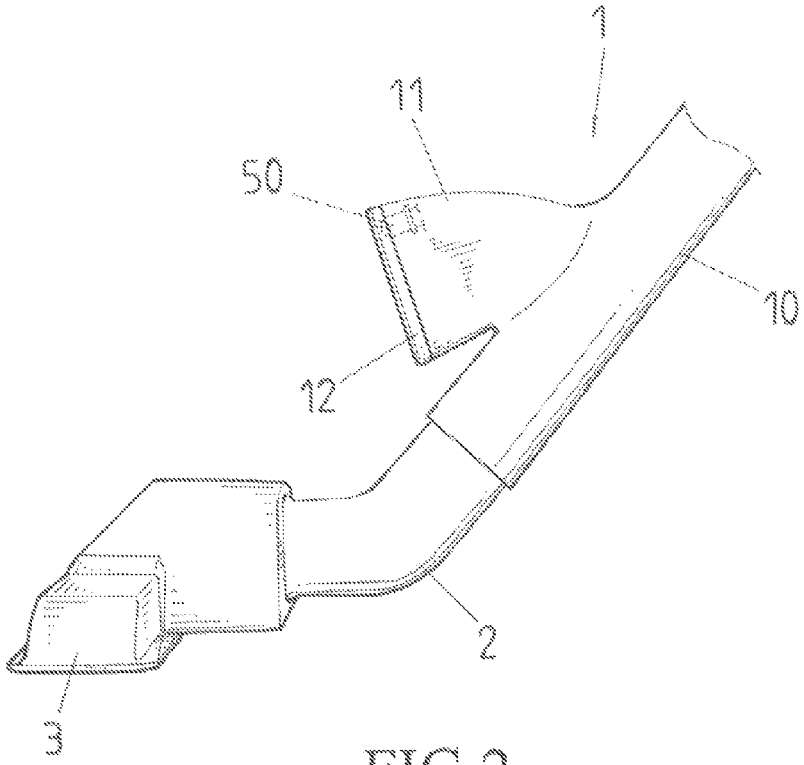
FIG. 2 shows a plan schematic view of the present invention.

Referring to FIG. 1 and FIG. 2, the present invention comprises two symmetric housings 10, a connection tube 2 and a suction base 3, wherein a lower side of the housings 10 is connected with the connection tube 2, a lower side of the connection tube 2 is connected with the suction base 3 and a side of the housings 10 is provided with a chamber 11.

Figure 3:
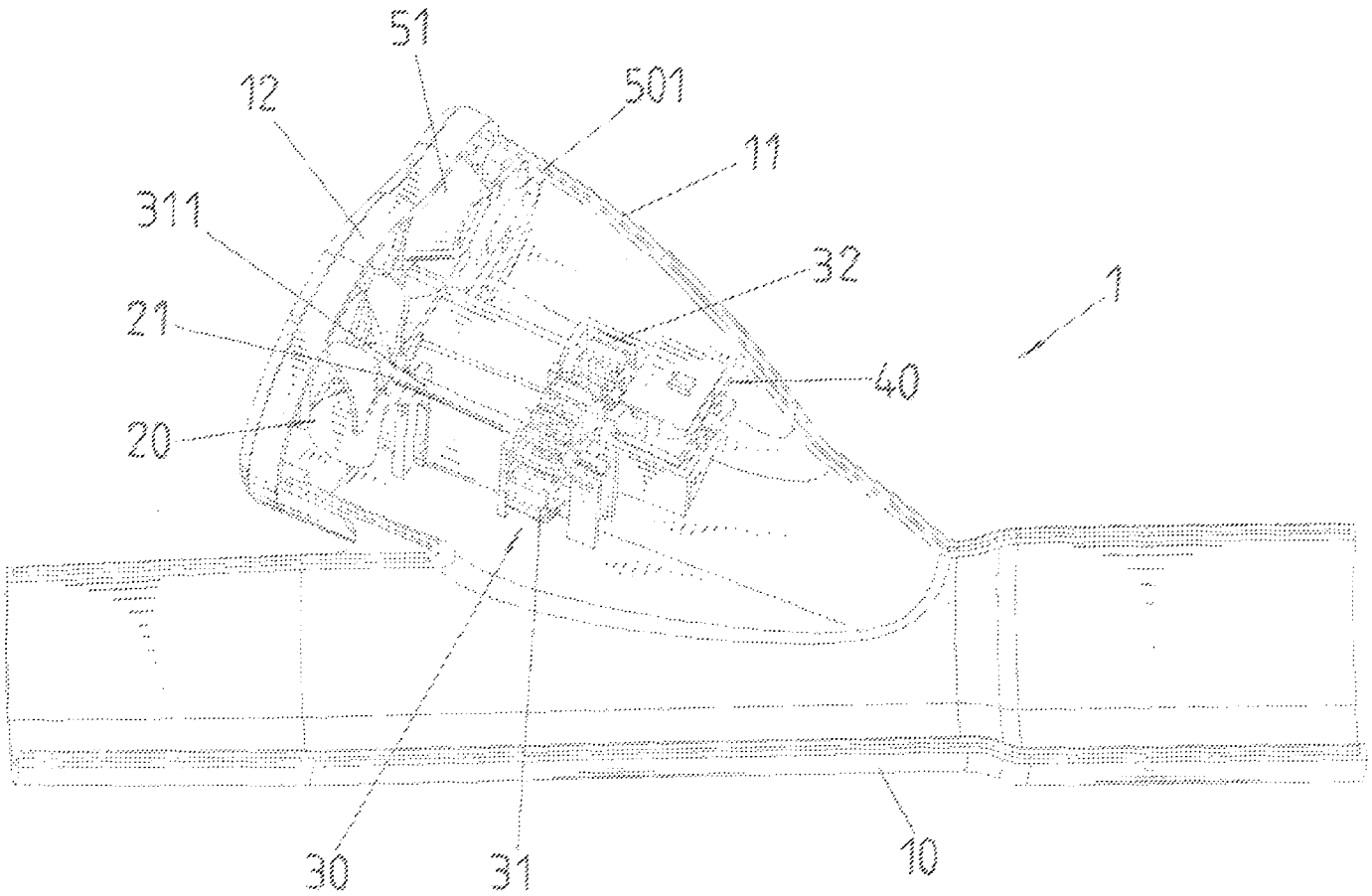
FIG. 3 shows a schematic view of internal structures of housings of the present invention, with that the internal structures are assembled together.
Figure 4:
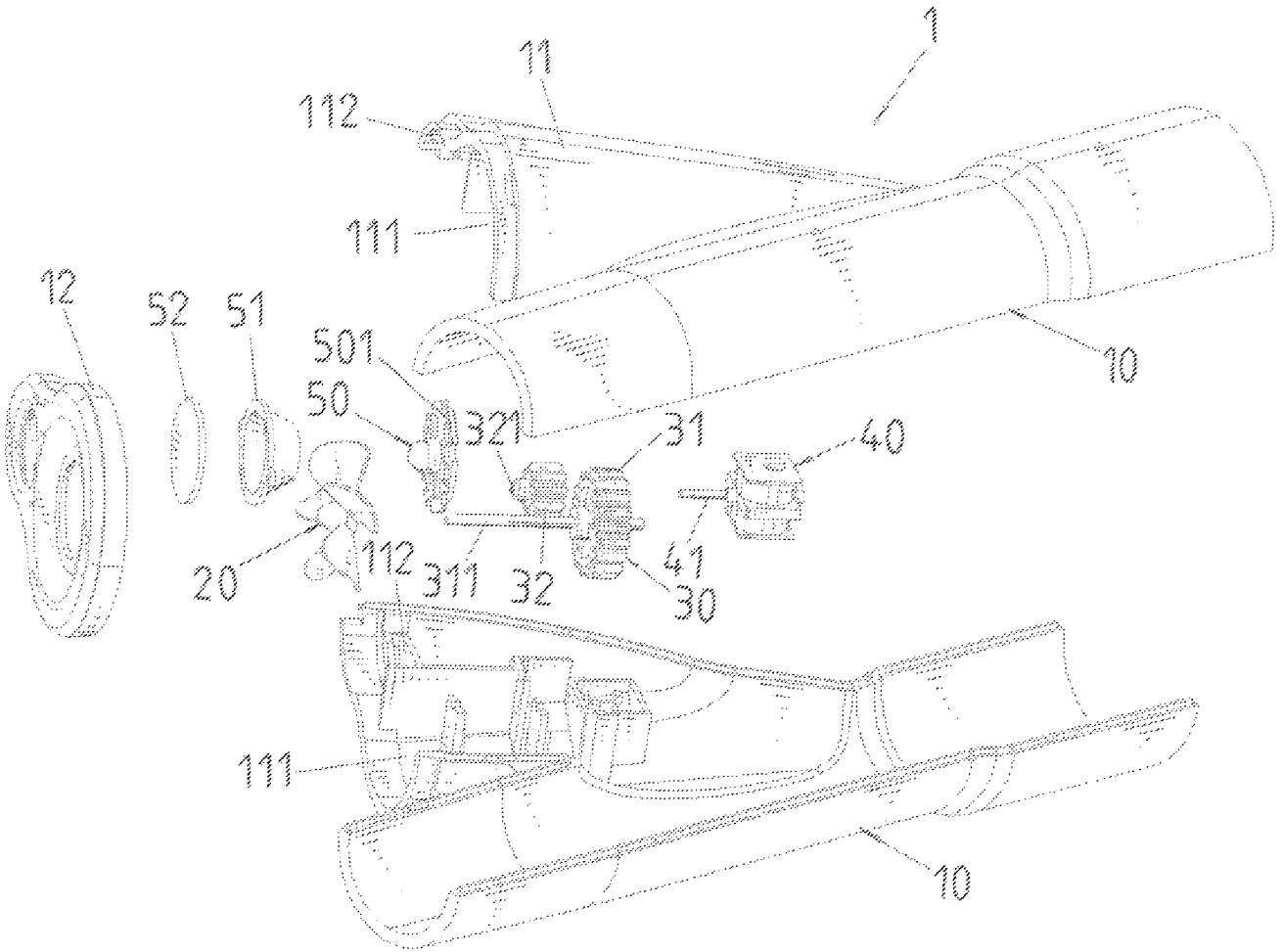
FIG. 4 shows an exploded view of the internal structures of the housings of the present invention.

Referring to FIG. 3 and FIG. 4, an interior of the chamber 11 is installed with fan blades 20, an acceleration gear set 30, a generator 40 and an LED 50. The chamber 11 is provided with an air inlet 111 and a lamp hole 112, the fan blades 20 are installed at the air inlet 111 of the chamber 11, and the acceleration gear set 30 includes a large gear 31 and a small gear 32, wherein a transmission shaft 311 at an axis of the large gear 31 is latched into a latch hole 21 of the fan blades 20 (as shown in FIG. 3), the small gear 32 is gnawed with the large gear 31, whereas a transmission shaft 41 at an axis of the generator 40 is latched into a shaft hole 321 of the small gear 32. An interior of the lamp hole 112 of the chamber 11 is latched in with a lamp panel 501 on which is provided with at least one LED 50. The LED 50 is contained in a lamp socket 51 and a front rim of the lamp socket 51 is provided with a lamp shade 52. The generator 40 is electrically connected with the lamp panel 501 of the LED 50 by an electric wire. After the abovementioned parts have been installed, an exterior side of the chamber 11 is latched with a cover 12 to accomplish assembling.

Figure 5:
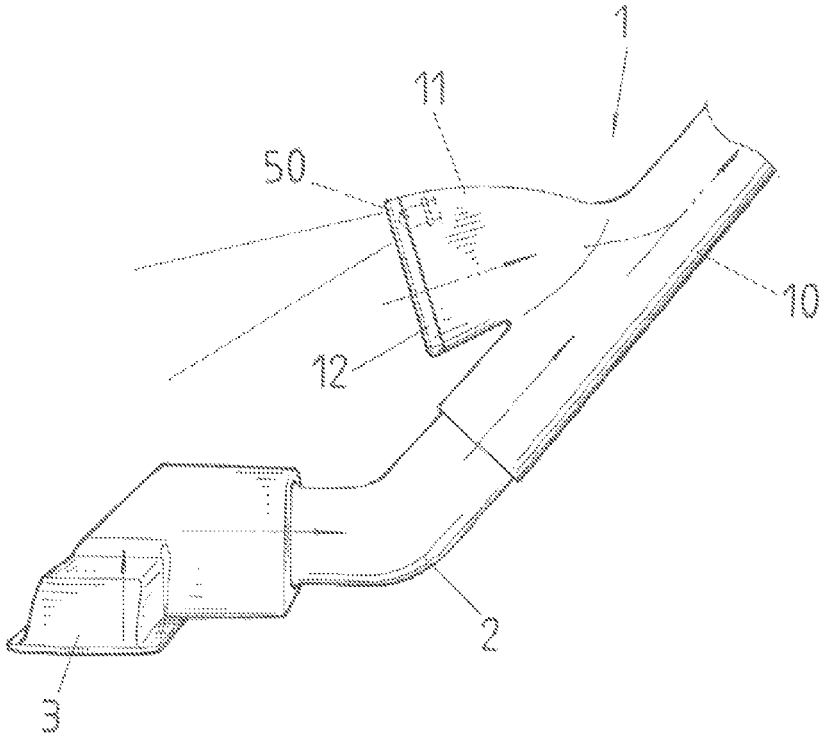
FIG. 5 shows a schematic view of an embodiment of the present invention.

Referring to FIG. 5, when a vacuum cleaner 1 is operating, a wind force is sucked in (as shown by the arrow) from the suction base 3 that touches a floor and enters into the housings 10 through the connection tube 2. A suction force of the vacuum cleaner 1 drives the wind force to enter into the vacuum cleaner 1 through the air inlet 111 of the chamber 11, at a same time. The entered wind force is converted into mechanical energy at the fan blades 20 and is then speeded up by the acceleration gear set 30, with that wind-driven power is transmitted to the generator 40 to produce electricity. The newly produced electricity is then transmitted to the LED 50 (not shown in the drawing) through an electric wire to emit light for illumination.

In conclusion, an interior of an ordinary vacuum cleaner is installed with a wind-driven power generation device formed by the fan blades, the acceleration gear set and the generator, wherein the suction force of the vacuum cleaner is converted into the wind-driven power to provide the electricity needed by the LED, so that the LED illuminates while energy is saved.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A vacuum cleaner with wind-driven lighting equipment, comprising:

two symmetric housings, a side of which is provided with a chamber having an air inlet and a lamp hole;

a connection tube which is connected below the housings; and a suction base which is connected below the connection tube;

an interior of the chamber being installed with fan blades, an acceleration gear set, a generator and an LED, with that the fan blades are installed at the air inlet of the chamber, the acceleration gear set includes a large gear and a small gear, wherein a transmission shaft at an axis of the large gear is latched into a latch hole of the fan blades, a transmission shaft at an axis of the generator is latched into a shaft hole of the small gear, the large and small gears are gnawed together, the lamp hole of the chamber is latched in with a lamp panel on which is provided with at least one LED, whereas the generator is electrically connected with the lamp panel by an electric wire.

2. The vacuum cleaner with wind-driven lighting equipment, according to claim 1, wherein the LED is contained in a lamp socket and a front rim of the lamp socket is provided with a lamp shade.

3. The vacuum cleaner with wind-driven lighting equipment, according to claim 1, wherein an exterior side of the chamber is latched with a cover.

* * * * *